US006332760B1

(12) United States Patent
Chung

(10) Patent No.: US 6,332,760 B1
(45) Date of Patent: Dec. 25, 2001

(54) INFLATABLE PRODUCT PROVIDED WITH BUILT-IN BATTERY CASE AND SOCKET

(75) Inventor: Wang Cheng Chung, Taipei (TW)

(73) Assignee: Team Worldwide Corporation, Taipei (TW)

( * ) Notice: Subject to any disclaimer, the term of this patent is extended or adjusted under 35 U.S.C. 154(b) by 0 days.

(21) Appl. No.: 09/542,477

(22) Filed: Apr. 4, 2000

(51) Int. Cl.[7] ..... F04B 19/00; F04B 17/00; A47C 27/08

(52) U.S. Cl. ..... 417/411; 417/239; 5/706

(58) Field of Search ..... 417/239, 238, 417/360, 411, 423.15; 5/706

(56) References Cited

U.S. PATENT DOCUMENTS 4,678,014 * 7/1987 Owen et al. ..... 141/67
5,057,819 * 10/1991 Valenti ..... 340/573
5,068,933 * 12/1991 Sexton ..... 5/441
5,216,778 * 6/1993 Suzuki et al. ..... 15/327.1
5,367,726 * 11/1994 Chaffee ..... 5/449
5,584,084 * 12/1996 Klearman et al. ..... 5/714
5,606,756 * 3/1997 Price ..... 5/713

* cited by examiner

*Primary Examiner*—Charles G. Freak
*Assistant Examiner*—Timothy P. Solak
(74) *Attorney, Agent, or Firm*—Michael D. Bednarek; Shaw Pittman LLP

(57) ABSTRACT

An inflatable product includes an inflatable body, a socket, an electric pump and a battery case. The socket is built in the inflatable body. The electric pump is detachably connected to the socket to pump the inflatable body. The battery case is also built in the inflatable body for receiving batteries to supply the electric pump with power.

8 Claims, 8 Drawing Sheets

INFLATABLE PRODUCT PROVIDED WITH BUILT-IN BATTERY CASE AND SOCKET

BACKGROUND OF THE INVENTION

1. Field of the Invention

The present invention relates in general to an inflatable product provided with a built-in battery case and socket.

2. Description of the Related Art

Referring to FIGS. 1A and 1B, a conventional electric pump 14 for inflating an airbed has a fan and motor 142 inside. A plurality of batteries 144 are loaded into the electric pump 14 to supply the power. The airbed 10 is provided with a valve 12. In operation, the electric pump 14 is moved in direction B to connect the valve 12 and then rotated in direction A to fasten the connection between the electric pump 14 and the airbed 10.

SUMMARY OF THE INVENTION

An object of the present invention is to provide a modified airbed, which is inflated and deflated in a different way.

The airbed of the present invention includes an inflatable body, a socket, an electric pump and a battery case. The socket is built in the airbed. The electric pump is detachably connected to the socket to pump the airbed. The battery case is also built in the airbed for receiving batteries to supply the electric pump with power.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1A:
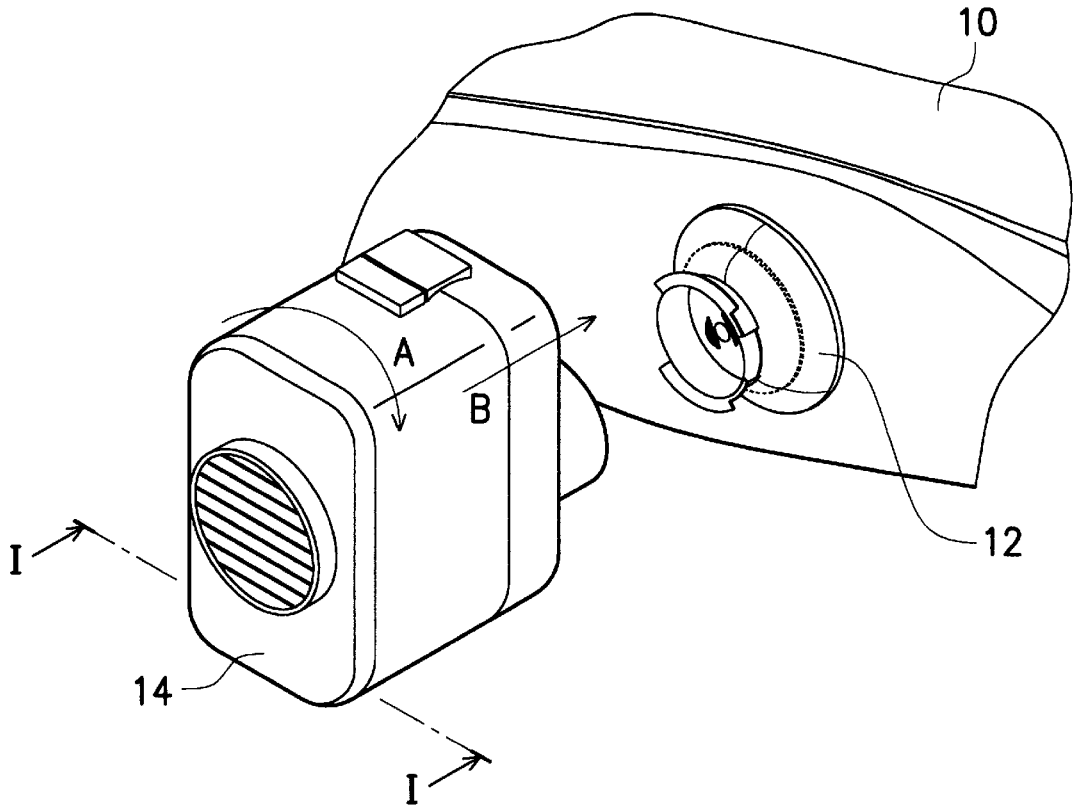
FIG. 1A (PRIOR ART)
FIG. 1A depicts a conventional airbed.
Figure 1B:
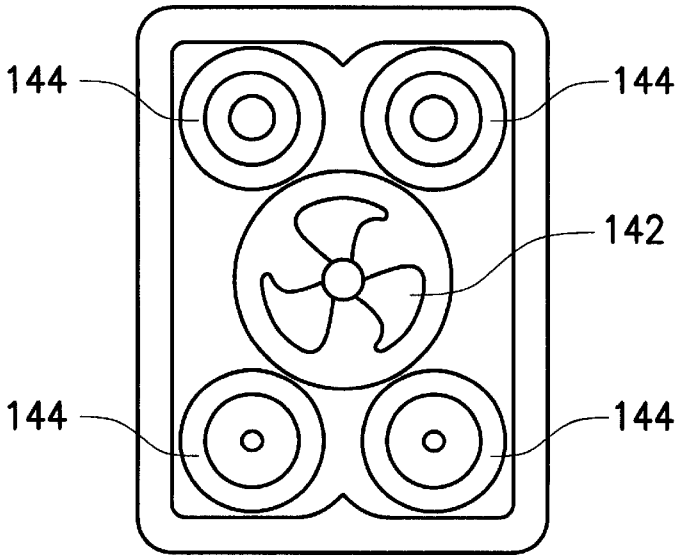
FIG. 1B (PRIOR ART)
FIG. 1B is a sectional view along line I—I in FIG. 1A.
Figure 2:
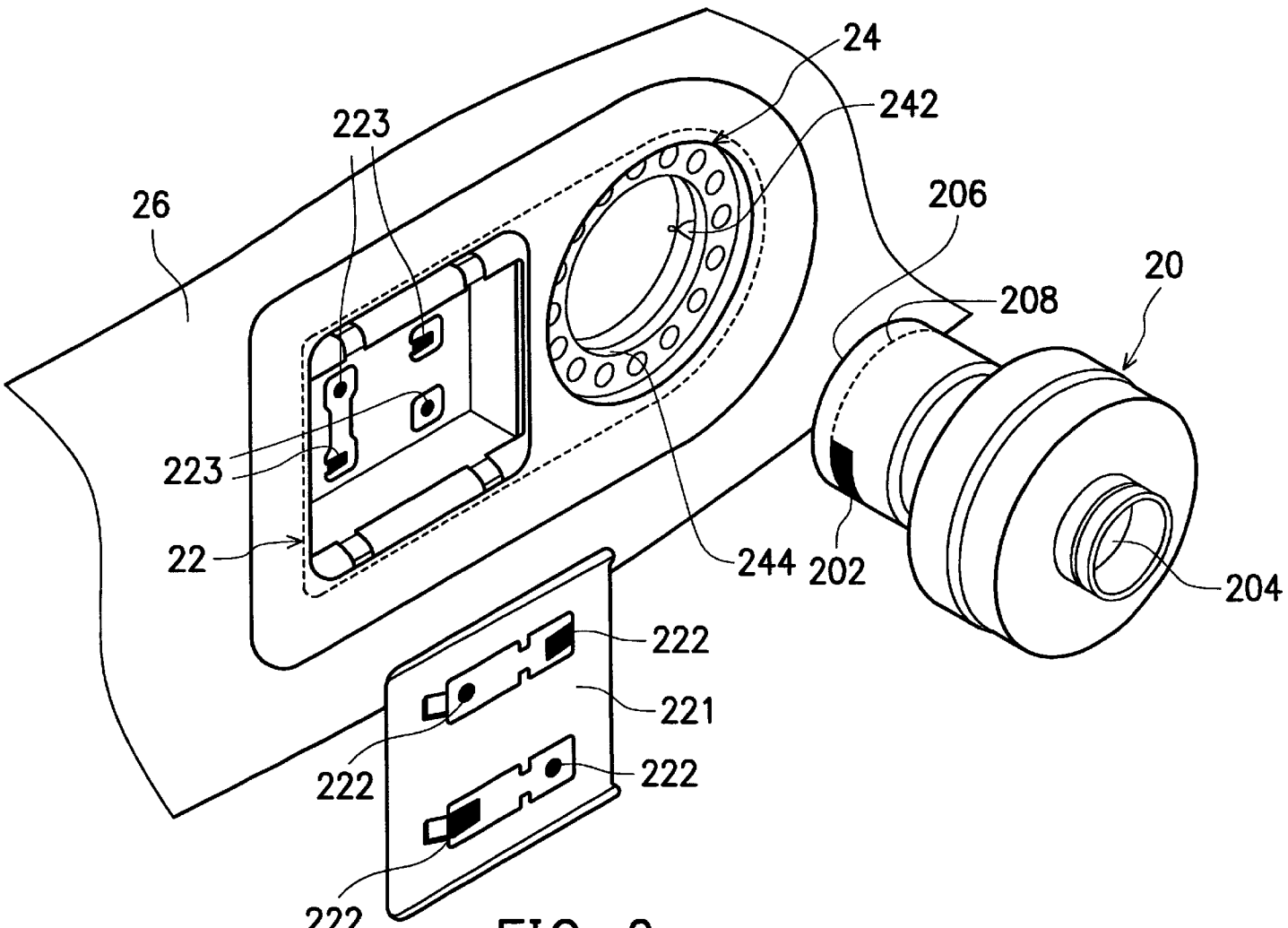
FIG. 2 locally depicts an airbed in accordance with a first embodiment of the present invention.

Referring to FIG. 2, an airbed 26 of a first embodiment of the present invention is provided with a detachable electric pump 20, a built-in battery case 22 and a built-in socket 24. The battery case 22 has a cover 221 on which electrodes 222 are provided. Also, on the bottom of the battery case 22 are provided electrodes 223 corresponding to the electrodes 222 of the cover 221. An O-ring 244 and an electrode 242 are provided on the inner wall of the socket 24, wherein the electrode 242 is electrically connected to the electrodes 222, 223 of the battery case 22. Furthermore, the electric pump 20 is substantially cylindrical and has an electrode 202 on its side surfaces, an air inlet 204 and an air outlet 206 on its ends and a check valve 208 inside. The check valve 208 of the electric pump allows air to flow in a single direction from the inlet 204 to the outlet 206.

Figure 3B:
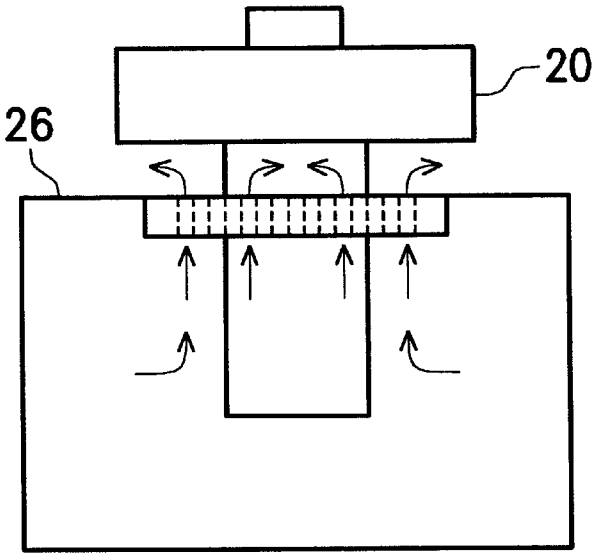
FIG. 3B shows the deflating operation of the airbed of the first embodiment.
Figure 3A:
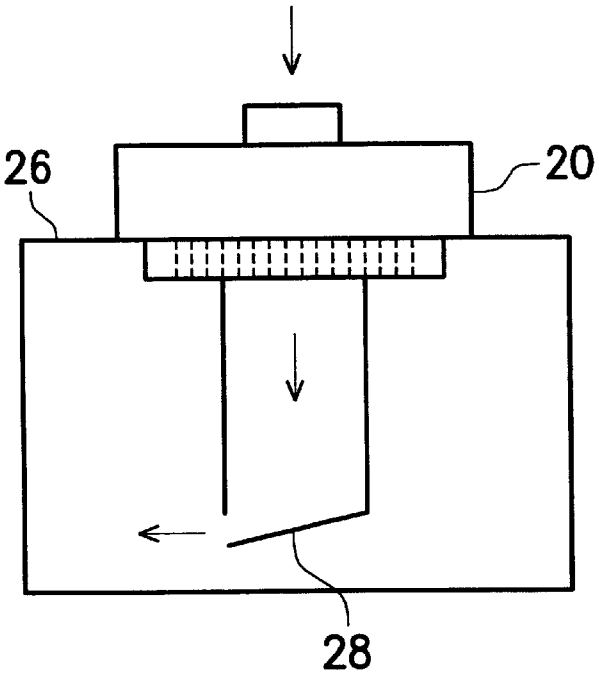
FIG. 3A shows the inflating operation of the airbed of the first embodiment.

In operation, batteries are loaded into the battery case 22. The electric pump 20 is fitted into the socket 24 and then rotated so that the electrode 202 of the electric pump 20 contacts the electrode 242 of the socket 24. Then, the electric pump 20 is actuated to pump outside air into the airbed 26 as shown in FIG. 3A. The O-ring 242 in the socket 24 prevents the airbed 26 from leaking. In deflating operation, the user detaches the electric pump 20 from the socket 24 to deflate the airbed 26, as shown in FIG. 3B.

It is understood that the O-ring can be provided on the side surfaces of the electric pump 20 instead of in the socket 24 to prevent the airbed from leaking.

Figure 4:
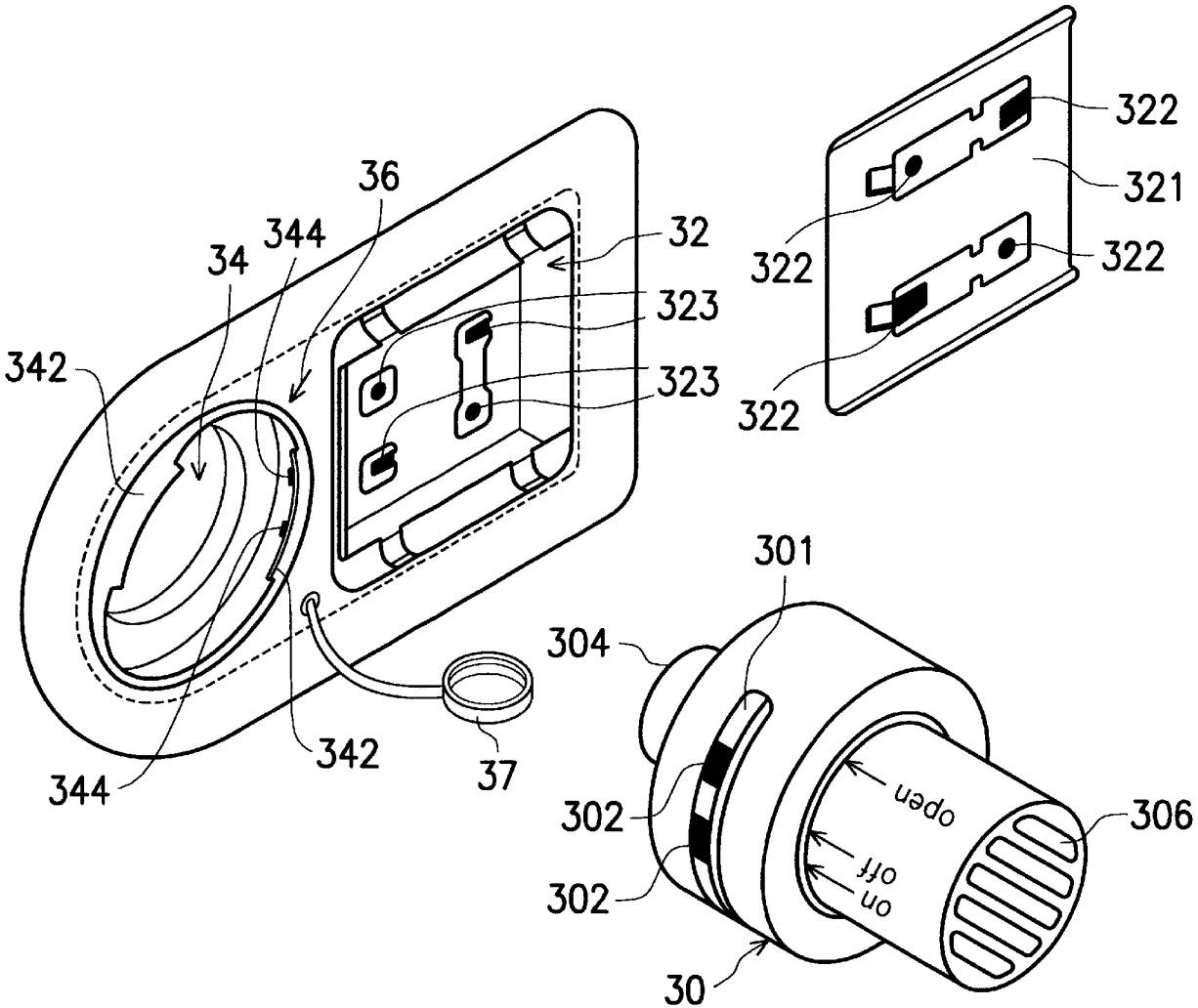
FIG. 4 locally depicts an airbed in accordance with a second embodiment of the present invention.
Figure 5:
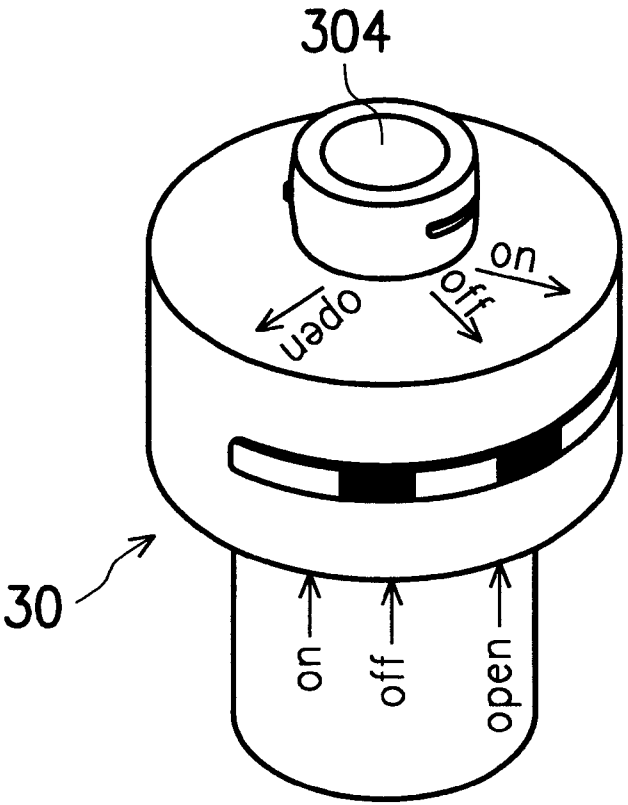
FIG. 5 is a perspective diagram of the electric pump of the second embodiment.

Referring to FIG. 4, an airbed of a second embodiment of the present invention is provided with a detachable electric pump 30, a cap 37 for the electric pump 30, a built-in battery case 32 and a built-in socket 34. The battery case 32 has a cover 321 on which electrodes 322 are provided. Also, on the bottom of the battery case 32 are provided electrodes 323 corresponding to the electrodes 322 of the cover 321. Furthermore, an arrow symbol 36 is marked on the airbed and besides the socket 34. Flanges 342 are formed at the rim of the socket 34, while electrodes 344 are provided on the inner wall of the socket 34 and are electrically connected to the electrodes 322, 323 of the battery case 32. Furthermore, the electric pump 30 is substantially cylindrical and has a flange 301 on its side surfaces, two electrodes 302 provided on the flange 301, an air inlet 304 and an air outlet 306 on its ends. Also referring to FIG. 5, symbols "on", "off" and "open" are marked on the side surfaces and the end of the electric pump 30.

Figure 6A:
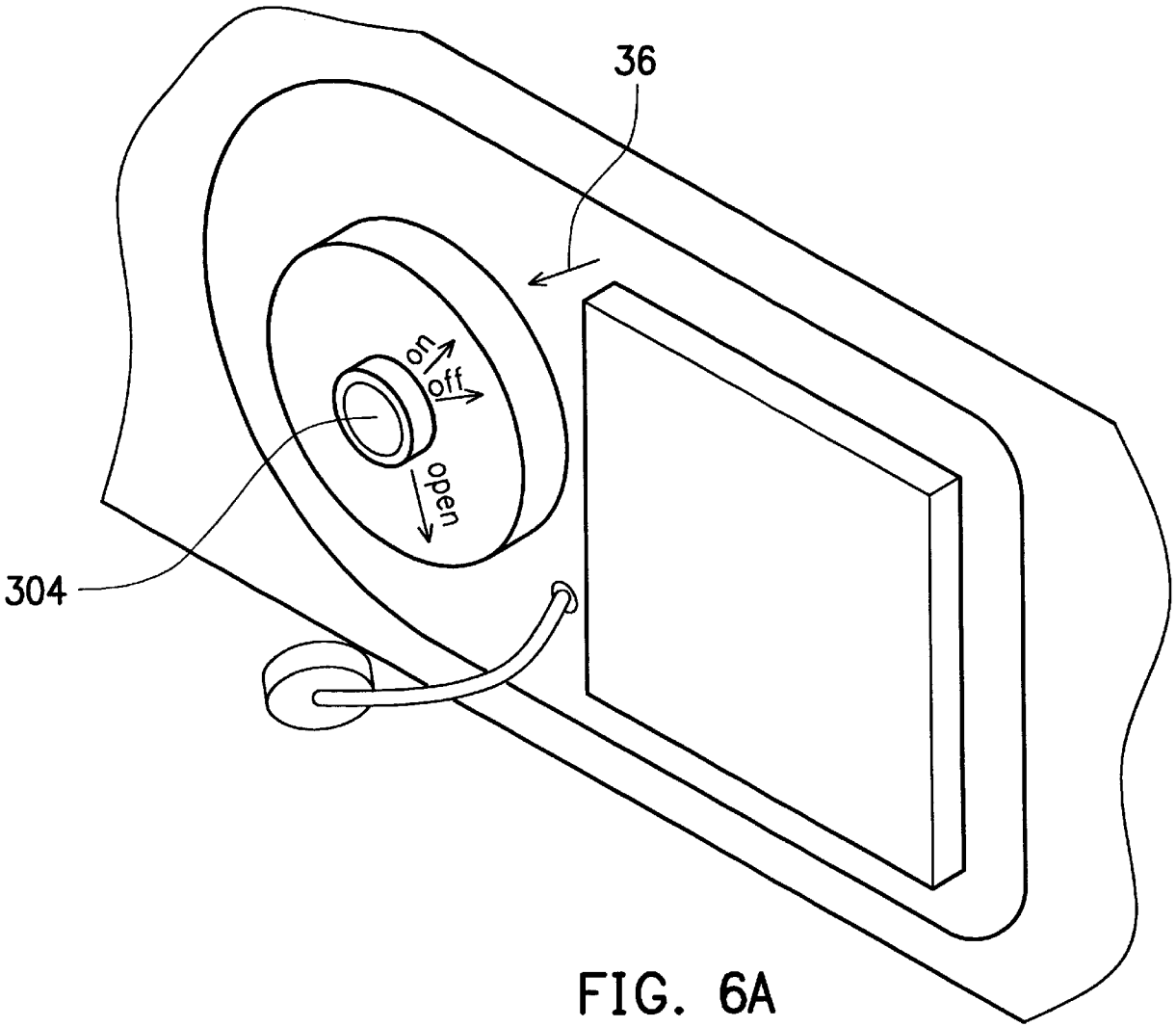
FIGS. 6A, 6B and 6C show the inflating operation of the airbed of the second embodiment.
Figure 6C:
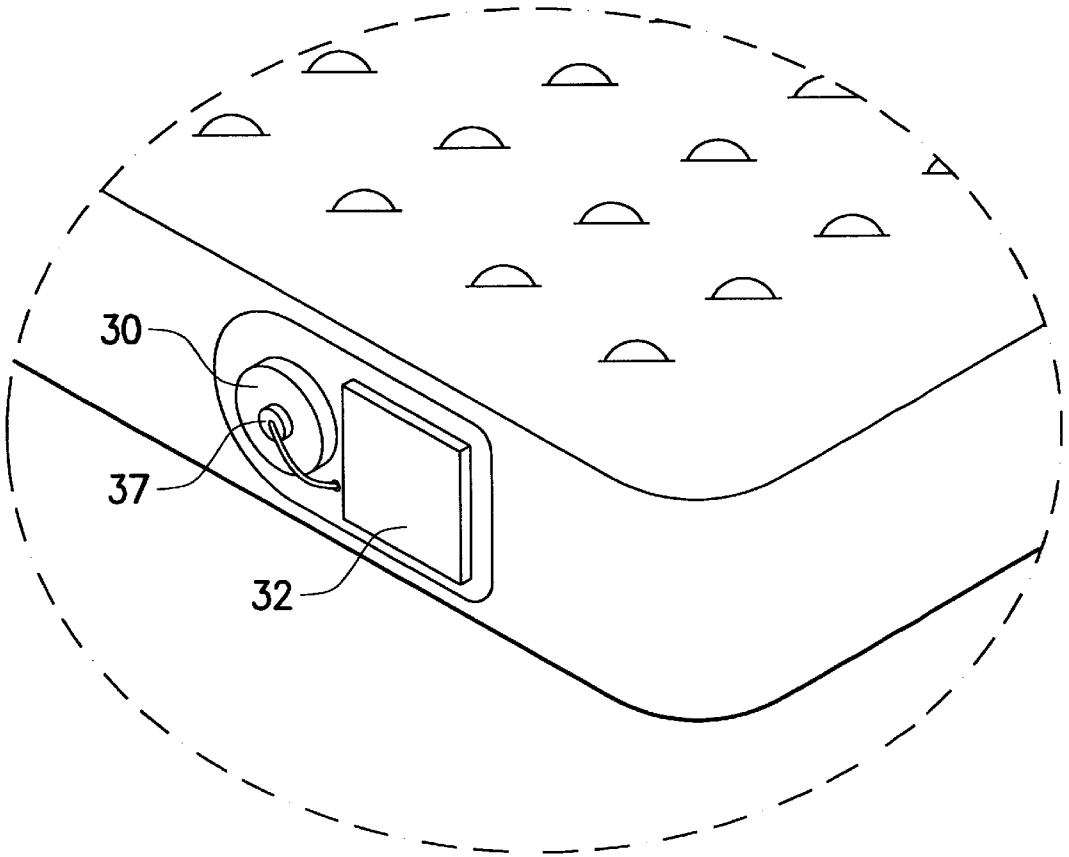
Figure 6B:
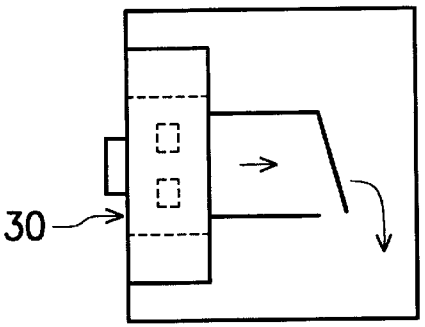

In operation, batteries are loaded into the battery case 32 to supply the electric pump 30 with the power. The electric pump 30 in this embodiment is used to inflate or deflate the airbed. In inflating operation, the electric pump 30 is fitted into the socket 34 with the air outlet 306 inside the airbed and the air inlet 304 outside the airbed. The electric pump 30 is rotated to change the positions of symbols "on", "off" and "open". When the arrow symbol 36 points at the symbol "on" as shown in FIG. 6A, the electrodes 302 of the electric pump 30 contact the electrodes 344 of the socket 34 to actuate the electric pump 30. Then, outside air is pumped into the airbed as shown in FIG. 6B. When the arrowsymbol 36 points at the symbol "off", the electric pump 30 is stopped. When the arrow symbol 36 points at the symbol "open", the electric pump 30 is detachable from the socket 34. FIG. 6C depicts the airbed full of air, wherein the air outlet of the electric pump 30 is closed by the cap 37 to seal the airbed after the inflating operation.

Figure 7B:
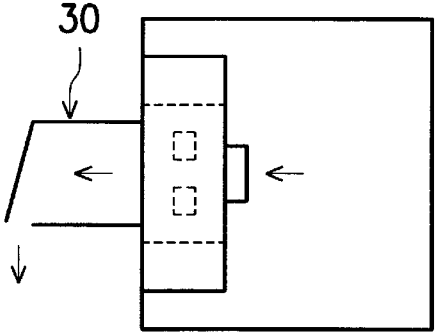
FIGS. 7A and 7B show the deflating operation of the airbed of the second embodiment.
Figure 7A:
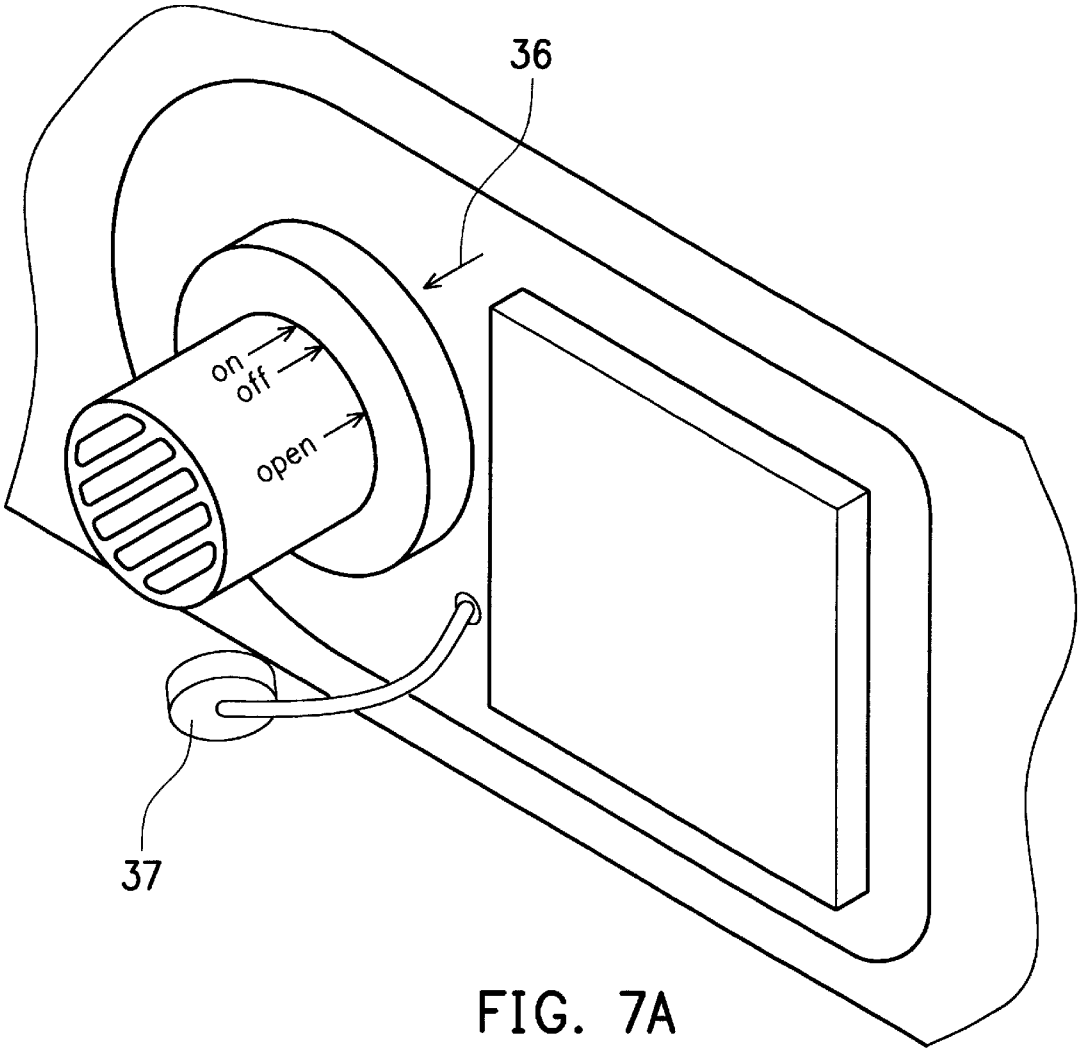

In deflating operation, the electric pump 30 is reversely fitted into the socket 34, with the air inlet 304 inside the airbed and the air outlet 306 outside the airbed. The electric pump 30 is rotated to change the positions of symbols "on", "off" and "open" on its side surfaces. When the arrow symbol 36 points at the symbol "on" as shown in FIG. 7A, the electrodes 302 of the electric pump 30 contact the electrodes 344 of the socket 34 to actuate the electric pump 30. Then, air inside the airbed is pumped out as shown in FIG. 7B. When the arrow symbol 36 points at the symbol "off", the electric pump 30 is stopped. When the arrow symbol 36 points at the symbol "open", the electric pump 30 is detachable from the socket 34.

In either of the inflating and deflating operations, the flanges 342 of the socket 34 are used for confining the flange

301 of the electric pump 30, thus preventing the electric pump 30 from separating with the socket 34 when the arrow symbol 36 points at the symbols "on" and "off". However, the flanges 342 are spaced apart at the rim of the socket 34 to avoid confining the flange 301 of the electric pump 30 when the arrow symbol 36 points at the symbol "open". Thus, the electric pump 30 is detachable from the socket 34 when the arrow symbol 36 points at the symbol "open".

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inflatable product including:

an inflatable body;

a socket built in the inflatable body;

an electric pump detachably connected to the socket to pump the inflatable body; and a battery case also built in the inflatable body for receiving batteries to supply the electric pump with power.

2. An inflatable product as claimed in claim 1, wherein the socket has at least one first electrode inside to electrically connect the batteries, the electric pump has at least one second electrode, the electric pump is actuated to pump the inflatable body when the electric pump is rotated to a first position so that the at least one second electrode contacts the at least one first electrode, and the electric pump is stopped when the electric pump is rotated to a second position so that the at least one first electrode and the at least one second electrode separate.

3. An inflatable product as claimed in claim 2, wherein the socket further has confining means for preventing the electric pump from separating with the socket when the electric pump is at the first and second positions, and the electric pump is released from the confining means when the electric pump is rotated to a third position.

4. A method of inflating an inflatable product including the steps of:

providing an electric pump;

providing a built-in battery case in the inflatable product;

loading batteries into the battery case; and connecting the electric pump to a socket in a first direction to pump the inflatable product, wherein the batteries supply the electric pump with power.

5. A method as claimed in claim 4, further including the step of separating the electric pump from the socket to directly deflate the inflatable product through the socket.

6. A method as claimed in claim 4, further including the steps of:

(d) separating the electric pump from the socket;

(e) connecting the electric pump to the socket in a second direction opposite to the first direction to pump air inside the inflatable product out.

7. An inflatable product as claimed in claim 1, wherein the socket has at least one first electrode inside to electrically connect the batteries, the electric pump has at least one second electrode, the electric pump is actuated to deflate the inflatable body when the electric pump is rotated to a first position so that the at least one second electrode contacts the at least one first electrode, and the electric pump is stopped when the electric pump is rotated to a second position so that the at least one first electrode and the at least one second electrode separate.

8. An inflatable product including:

an inflatable body;

a socket built in the inflatable body;

an electric pump detachably connected to the socket to pump the inflatable body;

a battery case also built in the inflatable body; and at least one battery disposed in the battery case to supply the electric pump with power.

* * * * *